US006419773B1

(12) United States Patent
Lauermann

(10) Patent No.: US 6,419,773 B1
(45) Date of Patent: Jul. 16, 2002

(54) DRYWALL TAPE AND COMPOUND APPLICATOR

(76) Inventor: William C. Lauermann, 6538 Ayres Lane Rd., Snow Hill, MD (US) 21863

( * ) Notice: Subject to any disclaimer, the term of this patent is extended or adjusted under 35 U.S.C. 154(b) by 0 days.

(21) Appl. No.: 09/460,211

(22) Filed: Dec. 13, 1999

(51) Int. Cl.[7] ..... B05C 17/10

(52) U.S. Cl. ..... 156/71; 156/201; 156/575; 156/577; 156/578; 156/579

(58) Field of Search ..... 156/71, 199, 200, 156/201, 574, 575, 577, 578, 579; 425/87

(56) References Cited

U.S. PATENT DOCUMENTS

| | | | | |
|---|---|---|---|---|
| 4,689,107 A | | 8/1987 | Entwistle | 156/465 |
| 4,767,297 A | | 8/1988 | Mower et al. | 425/87 |
| 4,775,442 A | | 10/1988 | Januska | 156/575 |
| 5,029,552 A | | 7/1991 | Ovens | 118/419 |
| 5,230,608 A | | 7/1993 | Januska | 417/44 |
| 5,263,836 A | * | 11/1993 | Tinawong | 425/87 |
| 5,279,700 A | | 1/1994 | Retti | 156/578 |
| 5,419,693 A | * | 5/1995 | MacMillan | 425/87 |
| 5,423,666 A | * | 6/1995 | MacMillan | 425/87 |
| 5,622,729 A | * | 4/1997 | Mower | 425/87 |
| 5,676,793 A | | 10/1997 | Martin et al. | 156/578 |
| 5,695,788 A | * | 12/1997 | Woods | 425/87 |
| 5,730,819 A | | 3/1998 | Retti | 156/71 |
| 5,736,001 A | | 4/1998 | Samuelson | 156/575 |
| 6,155,809 A | * | 12/2000 | Edwards et al. | 425/87 |

* cited by examiner

*Primary Examiner*—James Sells

(57) ABSTRACT

A strip of drywall tape is simultaneously coated on its opposite front and rear surfaces as the tape is applied to a corner joint formed between a pair of abutting wall boards such as drywall panels. A tape guide provided on a drywall taping head guides a folded strip of drywall tape over a first reservoir of flowing drywall compound. The compound flows through the first reservoir and against the V-shaped front surface of the tape. The compound continues to flow over and around the front surface and over the rear surface of the tape and laterally into a pair of secondary reservoirs.

20 Claims, 3 Drawing Sheets

DRYWALL TAPE AND COMPOUND APPLICATOR

BACKGROUND OF THE INVENTION

1. Field of the Invention

The present invention relates in general to a tool for coating both sides of a strip of drywall tape with drywall joint compound, and relates in particular to an applicator head which simultaneously distributes pressurized joint compound directly to an exposed or outer surface of a drywall tape and to an underside or inner surface of a drywall tape as the applicator head is moved over a corner joint.

2. Description of Prior Developments

The joints formed between adjoining drywall or wallboard panels are generally covered with a lamination of joint compound and fibrous drywall tape to hide the cracks defined by and between the abutting panels. Joint compound and tape are typically applied manually by trowel or by a pressurized hand-operated tape and compound applicator to lay down a thin layer of compound and tape over each joint. The compound is typically applied only to that side of the tape which faces the wallboard panel.

Once the initial layer or coat of joint compound and tape is applied, it is smoothed over with a tool, such as a roller, and allowed to dry overnight. A relatively narrow and thin coating of joint compound is subsequently applied over the initial lamination of joint compound and tape using a trowel or a pressurized joint compound applicator. This second operation covers the exposed or outer side of the drywall tape and sandwiches the tape between the first layer of joint compound and the newly applied layer.

This second layer of joint compound is then allowed to dry. After it dries, a third wider layer of joint compound is then applied over the second layer. Sanding is then required to smooth over the joint.

Such prior methods are not only time consuming, but are also labor intensive and require considerable skill to achieve a smooth taped joint. Particular skill is needed to apply tape and compound over a corner joint. Accordingly, a need exists for a method and apparatus which reduces the time and effort required to form a finished wallboard joint having a wallboard tape sandwiched between two layers of wallboard compound during a single stroke of an applicator.

A further need exists for a method and apparatus for simultaneously applying wallboard compound to both sides of a wallboard tape as the wallboard tape is pressed against a joint between abutted wallboard panels.

A further need exists for such a method and apparatus which applies tape and compound to corner joints in a single application requiring no further application of compound to complete the taped joint.

The aforementioned objects, features and advantages of the invention will, in part, be pointed out with particularity, and will, in part, become obvious from the following more detailed description of the invention, taken in conjunction with the accompanying drawings, which form an integral part thereof.

SUMMARY OF THE INVENTION

The present invention has been developed to fulfill the needs noted above and therefore has as an object the provision of a method and apparatus for applying drywall compound to both sides of a wallboard tape as the tape is applied to a wallboard joint.

Another object of the invention is the provision of a method and apparatus for forming finished wallboard joints in a single step wherein wallboard compound is simultaneously applied to both sides of a wallboard tape as the tape is dispensed through an applicator and over a wallboard joint.

Yet another object of the invention is to provide such a method and apparatus for applying wallboard tape and compound to a corner joint where wallboard panels meet at substantially right angles.

These and other objects are achieved with the present invention which is directed to a method and apparatus for applying wallboard compound to front and rear sides of a wallboard tape as the tape is pulled through a taping applicator. Pressurized wallboard compound is fed to an applicator head through which a length of longitudinally-folded wallboard tape is guided. As the tape passes through the applicator head, wallboard compound is directed against the outer surface of the wallboard tape as well as around the outer surface of the tape and onto the rear or inner surface of the tape.

A pair of reservoirs or recesses is formed in the applicator head on both sides of the folded tape to apply a thin layer of joint compound over the tape and beyond the lateral edges of the tape. In this manner, a layer of joint compound is applied to the joint and laterally beyond the side edges of the tape so as to provide sufficient compound for a seamless laterally-tapered layer of joint compound.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various views of the drawings, like reference characters designate like or similar parts.

DETAILED DESCRIPTION OF THE PREFERRED EMBODIMENTS

Figure 1:
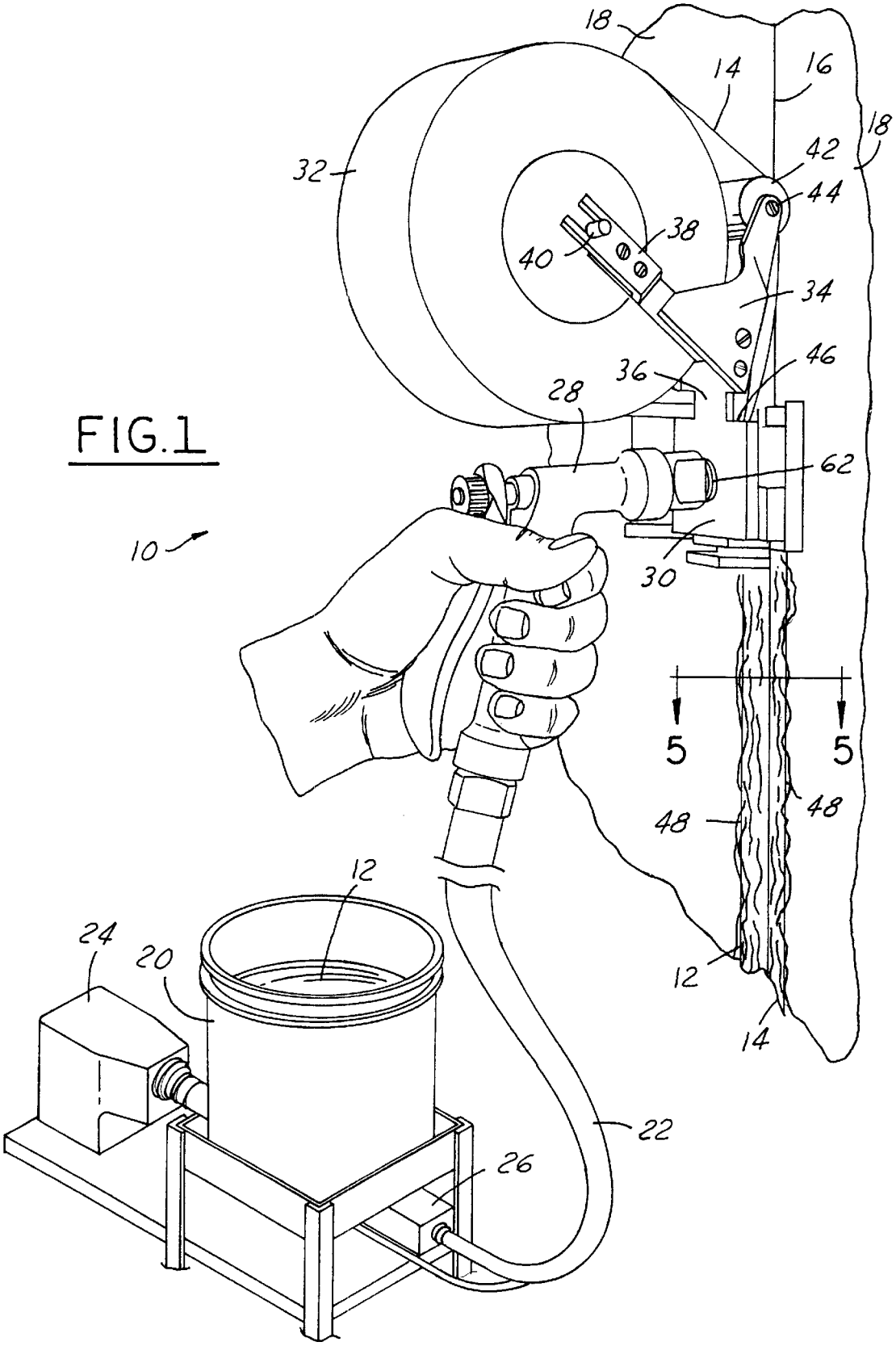
FIG. 1 is a schematic perspective view of a drywall tape and compound applicator constructed in accordance with the invention.

The present invention will now be described in conjunction with the drawings, beginning with FIG. 1 which shows a system 10 for applying drywall compound 12 to both sides of a drywall tape 14 as the tape is being applied to a joint 16 defined between a pair of abutting drywall or wallboard panels 18. System 10 includes a pressurized source of drywall compound or "mud" 12 which may be mixed in a bucket 20 and pumped through a hose 22 in a known fashion. For example, motor 24 drives a pump 26 which receives compound 12 from a port formed in the bottom of bucket 20 in a manner such as that disclosed in U.S. Pat. No. 5,230,608 which is incorporated herein by reference.

The pressurized compound, which typically has a consistency similar to soft flowable putty, is driven through hose 22 into a hand-held nozzle 28 of the type used on garden hoses. Nozzle 28 is screwed into an applicator head 30 which will be described in more detail further below. A roll 32 of wallboard tape 14 is mounted to a pair of matched brackets 34 which are rigidly affixed to a mounting plate 36 mounted to the applicator head 30.

A yoke 38 is attached to each bracket 34 for receiving an axle or shaft 40 which rotates along with the tape roll 32 in each yoke 38. A roller 42 is also mounted between the brackets 34 on a fixed shaft 44. The tape is dispensed from roll 32 over roller 42 and into an elongated guide slot 46 formed in a tape guide 100 provided on the applicator head 30. As the tape 14 enters the guide slot 46, it is longitudinally folded in half in a manner similar to that shown in U.S. Pat. Nos. 4,689,107 and 4,775,442 which are incorporated herein by reference. The tape 14 is guided through the guide slot 46 by a pair of guide surfaces which define a narrow elongated passage through applicator head 30. This passage or slot is located along adjacent and parallel to the vertex of the V-shaped applicator head 30.

As the tape 14 passes through the applicator head 30, wallboard compound 12 is applied to virtually the entire surfaces of both sides of the tape. Wallboard compound 12 is also applied to both wallboard panels 18, 18 beyond the lateral edges 48, 48 of the tape 14. In this manner, as the applicator head 10 is moved upwardly along joint 16 in FIG. 1, the wallboard tape 14 is laminated between thin layers of wallboard compound 12.

If necessary, the laminated or layered tape and compound can be flattened against each wallboard panel 18,18 with a putty knife or trowel after the tape is severed or cut from the applicator head 30.

Figure 2:
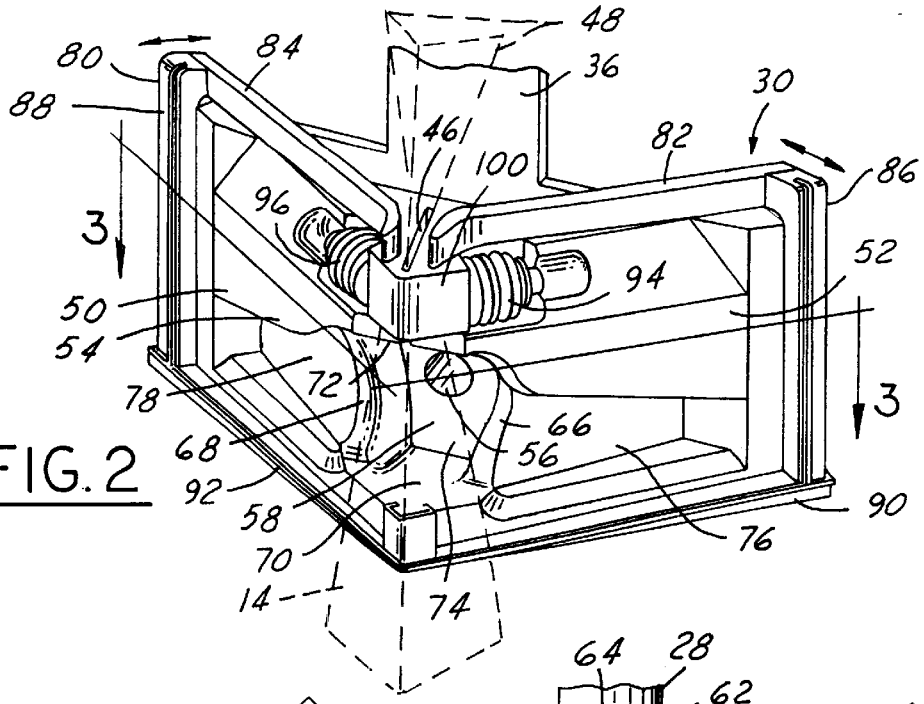
FIG. 2 is a partial perspective view of the applicator head of FIG. 1.

As seen in FIG. 2, the applicator head 30 includes a generally V-shaped applicator body 50 which may be cast and/or machined from a metal such as aluminum or formed from a wear-resistant plastic material such as nylon or polycarbonate. Body 50 includes a pair of side walls 52, 54 which are disposed at a substantially right angle with one another so as to match the contour of a corner joint such as corner joint 16 formed between panels 18, 18 in FIG. 1.

Figure 3:
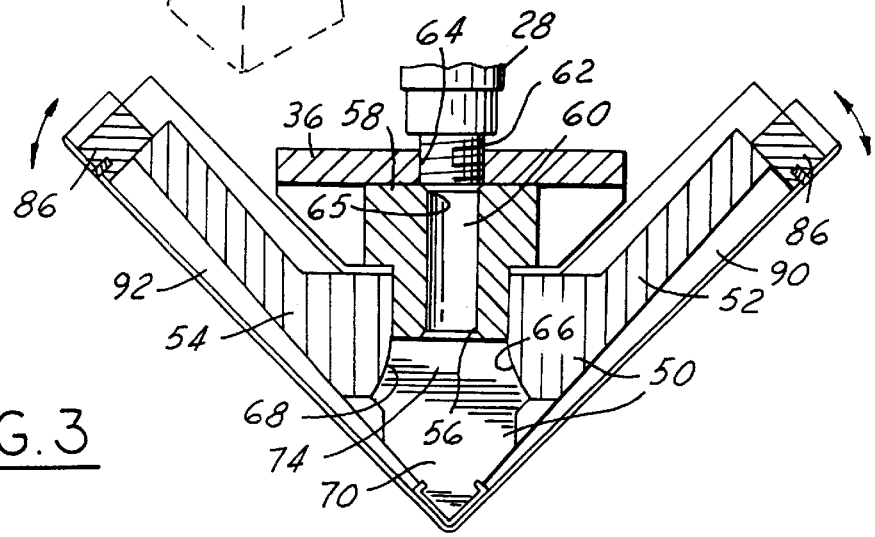
FIG. 3 is a view in section taken through section line 3—3 of FIG. 2.

An inlet port 56 is formed through a central connector 58 mounted to the rear surface of body 50. Port 56, as seen in FIG. 3, communicates with a flow channel 60 which extends through connector 58. The free end 62 of nozzle 28 may be threaded into grooves tapped into a bore 64 formed through mounting plate 36. Bore 64 is aligned with an inlet 65 in channel 60 to allow compound 12 to pass through the nozzle 28, mounting plate 36 and connector 58 and exit from port 56.

A pair of guide walls 66, 68 formed in applicator body 50 extends along opposite sides of connector 58 and port 56 between a floor 70 and roof 72 which are also formed in the applicator body 50. The walls 66, 68, floor 70 and roof 72 define a first dispensing trough or reservoir 74 which first receives the compound 12 flowing through port 56.

Second and third dispensing troughs or reservoirs 76, 78 respectively extending from guide walls 66, 68 communicate with the first dispensing trough 74. The second and third troughs 76, 78 are respectively formed as recesses in side walls 52, 54 on opposite sides of the first trough 74.

A pivoting frame 80 is mounted around body 50 in the same manner as that disclosed in aforementioned U.S. Pat. No. 4,767,297. Frame 80 includes a pair of upper frame members 82, 84, a pair of side frame members 86, 88 and a pair of bottom frame members 90, 92. The upper and lower frame members are rigidly interconnected to the bottom or lower frame members 90, 92 by the side frame members 86, 88.

The bottom frame members 90, 92 are pivotally connected at their abutting inner ends on body 50 and biased outwardly by an internal spring as disclosed in U.S. Pat. No. 4,767,297, incorporated herein by reference. As the applicator head 30 is pressed against the wallboard panels 18, 18, the frame 80 maintains biased contact against the panels with bottom frame members 90, 92 and side frame members 86, 88. A pair of rollers 94, 96 is mounted to sidewalls 52, 54 to reduce friction as the applicator head rolls and slides over the panels 18, 18.

An important feature of the invention is the provision of a tape guide 100 provided on the applicator head 30. Tape guide 100 is formed as a thin slot having parallel side walls aligned in applicator body 50 at the juncture or vertex between side walls 52, 54, and located above the first reservoir 74. The tape guide 100 includes the guide slot 46 noted above. Guide slot 46 has an elongated narrow inlet and an elongated narrow outlet and a channel that extends completely through the tape guide 100 and communicates with the first reservoir 74.

The tape guide 100 has a length and width sufficient to closely hold and guide a longitudinally doubled over or folded over length of tape 14 as shown in dashed lines in FIG. 2. The tape guide 100 is located between the second and third reservoirs which are located laterally of the tape guide.

As the tape enters and leaves the tape guide 100, it forms a bow tie shaped profile. As the applicator head 30 is manually pushed or pulled over joint 16, the tape is pulled into slot 46 and is pinched longitudinally together as it enters slot 46 and converges and tapers into a flat doubled over folded shape. As the tape exits slot 46, it diverges into a V-shaped profile as it is pulled over the V-shaped junction between the bottom frame members 90, 92. Excess compound is scraped from the outer side of the tape as it slides over the frame members 90, 92 and excess compound is squeezed and scraped from the inner side of the tape as the inner side of the tape is pressed against panels 18, 18 by the frame members 90, 92.

Figure 4:
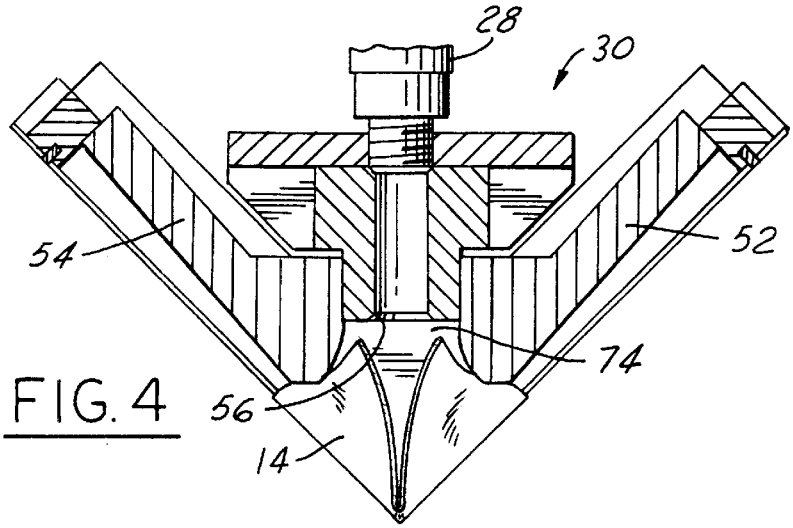
FIG. 4 is a view similar to FIG. 3, showing a section of drywall tape as it passes through the applicator head in a folded V-shaped form.
Figure 5:
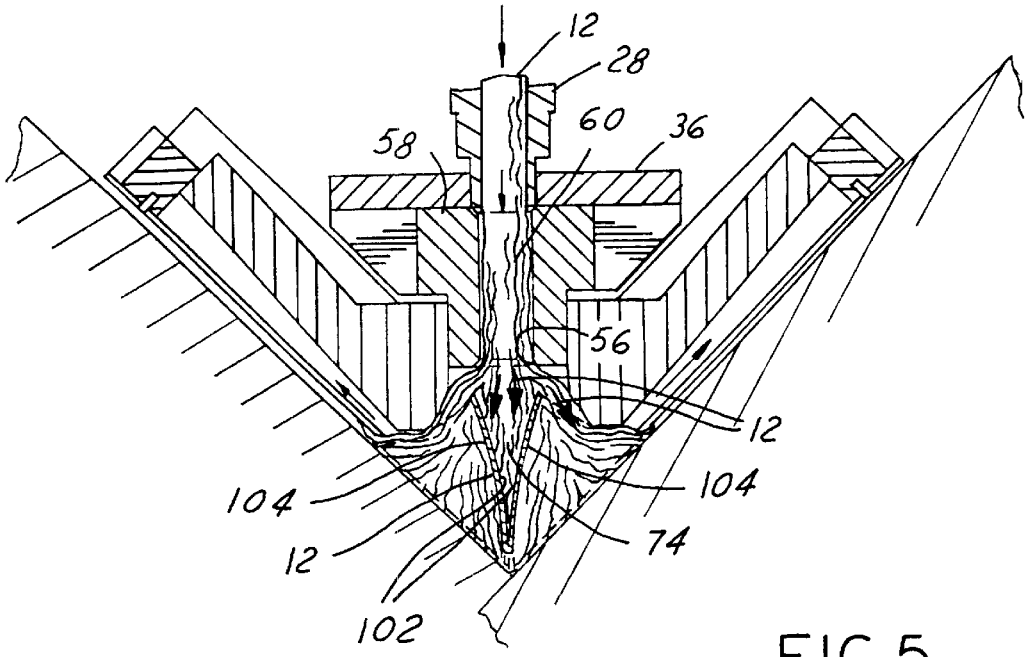
FIG. 5 is a view similar to FIG. 4, showing the flow paths of joint compound over both sides of the drywall tape.

As seen in FIGS. 2 and 4, the tape 14 is folded and held in position by the tape guide 100 in a generally V-shaped profile as the tape is pulled over and in front of port 56 and the first reservoir 74. As seen in FIG. 5, the compound 12 flows through nozzle 28, mounting plate 36, connector 58 via channel 60, exits from port 56 and enters the first reservoir 74. Some of the compound initially flows directly against the outer or upper surface 102 of the tape 12 and some compound flows over the inner or under surface 104 of the tape 12. The compound then flows laterally past the edges of the tape via reservoirs or troughs 76, 78 to cover the wallboard panels 18, 18 as required to produce a smooth finished joint.

The folded V-shaped profile of the tape 12 passing in front of the first reservoir 74 is narrower than the width of the first reservoir 74, i.e. narrower than the interior spacing between guide walls 66, 68, so that the compound 12 which fills the first reservoir 74 flows both into the V-shaped pocket formed by the outer surface of the tape and also over and around to the inner side of the tape to cover the rear or inner side of the tape. The compound then flows laterally under pressure into the second and third reservoirs 76, 78. In this manner, both sides of the tape are covered with compound.

Figure 6:
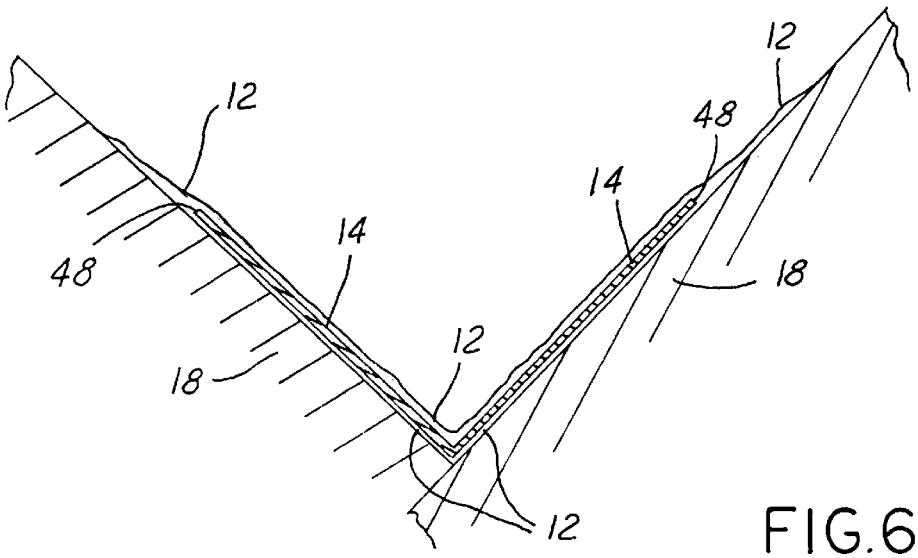
FIG. 6 is a view in section through the joint of FIG. 5 after the application of drywall tape and compound.

The compound 12 which flows into the second and third reservoirs forms thin tapered layers of compound over the tape and panels. These compound layers extend laterally beyond the lateral edges 48, 48 of the tape, as shown in FIG. 6. The laminated joint produced by tape 14 and compound 12 is somewhat thicker over the center folded portion of the tape and tapers laterally into a thinner layer of compound as the compound flows laterally outwardly of the central fold and beyond the side edges of the tape. These tapered layers of compound are formed naturally by the scraping and spreading action of the spring biased bottom frame members 90, 92 and are desirable for producing a seamless joint both over and beyond the edges of the compound-covered tape. As further seen in FIG. 6, the tape 12 is sandwiched or layered between two layers of compound 12 with a single stroke of applicator head 30. A putty knife or trowel may be used to smooth out the tape and compound in a known fashion after it has been applied by applicator head 30, but no additional application of compound is required. This results in a significant savings in time and labor.

There has been disclosed heretofore the best embodiment of the invention presently contemplated. However, it is to be understood that the various changes and modifications may be made thereto without departing from the spirit of the invention.

What is claimed is:

1. An apparatus for applying drywall compound to front and rear sides of a drywall tape, and laterally beyond side edges of said tape, said apparatus comprising:

an applicator head having an inlet for receiving said compound and a port for dispensing said compound;

a tape guide provided on said applicator head for guiding said tape adjacent said port;

a first reservoir provided in said applicator head for applying said compound to said front and rear sides of said tape; and second and third reservoirs provided on said applicator head for applying said compound laterally beyond said side edges of said tape.

2. The apparatus of claim 1, wherein said tape guide has a slot formed therethrough for receiving said tape.

3. The apparatus of claim 1, wherein said first reservoir communicates with said second and third reservoirs.

4. The apparatus of claim 1, wherein said tape is folded and pinched by said tape guide.

5. The apparatus of claim 1, wherein said applicator head comprises a first side wall and a second side wall and wherein said tape guide is located between said first and second side walls.

6. The apparatus of claim 1, wherein said applicator head comprises a first side wall and a second side wall and wherein said second and third reservoirs are respectively formed in said first and second side walls.

7. The apparatus of claim 1, wherein said first reservoir is located between said second and third reservoirs.

8. The apparatus of claim 1, wherein said applicator head comprises a V-shaped profile for applying said tape and compound to a corner joint.

9. The apparatus of claim 1, wherein said tape guide has an inlet and an outlet located between said second and third reservoirs.

10. A method of applying drywall compound to front and rear surfaces of a drywall tape while forming a taped joint over a pair of abutted panels, wherein said method comprises:

providing a drywall taping head having a tape guide;

longitudinally folding said tape to form a fold in said tape;

inserting said folded tape into said tape guide;

pulling said tape through said tape guide by moving said taping head over said panels;

applying said compound to both of said front and rear surfaces of said folded tape in a first portion of said taping head; and applying said compound to said pair of panels in a second portion of said taping head.

11. The method of claim 10, further comprising folding said tape in a V-shaped profile and applying said drywall compound to both said front and rear surfaces of said drywall tape in said applicator head while maintaining said tape in said V-shaped profile.

12. The method of claim 10, further comprising applying said compound to said panels laterally beyond said tape.

13. The method of claim 10, further comprising applying a thicker layer of said compound adjacent said tape and a thinner layer of said compound laterally outwardly of said tape.

14. An applicator for applying a flowable joint compound and a tape having inner and outer surfaces to a corner joint defined between a pair of abutted panels, said applicator comprising:

an applicator head having first and second side walls disposed at a substantially right angle with one another and defining a generally V-shaped profile;

a channel formed in said applicator head for supplying said compound to said inner and outer surfaces of said tape and to said joint; and a tape guide provided on said applicator, said tape guide comprising a pair of guide surfaces defining a tape passage located between said first and second side walls and aligned with said channel to guide said tape over said channel such that said compound is applied on said inner and outer surfaces of said tape.

15. The applicator of claim 14, wherein said tape guide is defined by a slot formed in said applicator head.

16. The applicator of claim 14, wherein said first and second side walls meet at a vertex and wherein said tape passage extends parallel to said vertex.

17. The applicator of claim 14, further comprising a first trough formed in said applicator head and communicating with said channel and with said tape passage.

18. The applicator of claim 17, further comprising a second trough and a third trough respectively formed in said first and second side walls for receiving said compound from said first trough.

19. The applicator of claim 14, further comprising said tape longitudinally folded within said tape guide.

20. The applicator of claim 19, wherein said tape defines a bow tie shaped profile as said tape extends into and out of said tape guide.

* * * * *